US012698694B2

(12) United States Patent
Sowers

(10) Patent No.: US 12,698,694 B2
(45) **Date of Patent: *Aug. 4, 2026**

(54) WATER PROCESSING SYSTEM AND METHOD

(71) Applicant: Hank James Sowers, London (GB)

(72) Inventor: Hank James Sowers, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 17/816,443

(22) Filed: Aug. 1, 2022

(65) Prior Publication Data

US 2022/0364440 A1 Nov. 17, 2022

Related U.S. Application Data

(63) Continuation of application No. 16/306,731, filed as application No. PCT/GB2017/051601 on Jun. 2, 2017, now Pat. No. 11,414,960.

(60) Provisional application No. 62/345,139, filed on Jun. 3, 2016.

(51) Int. Cl.

| | |
|---|---|
| ***E21B 36/00*** | (2006.01) |
| ***F22B 1/06*** | (2006.01) |
| ***F22B 3/06*** | (2006.01) |
| ***F22B 33/18*** | (2006.01) |

(52) U.S. Cl.

CPC ..... *E21B 36/00* (2013.01); *F22B 1/06* (2013.01); *F22B 3/06* (2013.01); *F22B 33/18* (2013.01)

(58) Field of Classification Search

None

See application file for complete search history.

(56) References Cited

U.S. PATENT DOCUMENTS

| | | | | |
|---|---|---|---|---|
| 2,429,035 | A | 10/1947 | Steving, Jr. | |
| 4,149,597 | A | 4/1979 | Redford | |
| 4,500,434 | A | 2/1985 | Jost et al. | |
| 2010/0089060 | A1 | 4/2010 | Ferguson et al. | |
| 2010/0282593 | A1 | 11/2010 | Speirs et al. | |
| 2011/0005749 | A1 | 1/2011 | Curole et al. | |
| 2011/0031163 | A1 | 2/2011 | Byrne et al. | |
| 2011/0048006 | A1 | 3/2011 | Cap et al. | |
| 2011/0259586 | A1 | 10/2011 | Latimer et al. | |
| 2012/0087737 | A1 | 4/2012 | Minnich et al. | |
| 2013/0056170 | A1 | 3/2013 | Klemencic | |
| 2013/0068458 | A1* | 3/2013 | Macadam | E21B 43/40 166/57 |
| 2013/0092153 | A1 | 4/2013 | O'Donnell et al. | |

(Continued)

FOREIGN PATENT DOCUMENTS

WO 2015054773 A1 4/2015

*Primary Examiner* — Anuradha Ahuja

(74) *Attorney, Agent, or Firm* — The Webb Law Firm

(57) ABSTRACT

A water processing system (10) comprises a reactor (12) configured to receive a feed water input (FW). The reactor (12) is configured to convert the feed water input (FW) into a steam output (S) for use in a downstream operation. The processing system (10) is configured to utilise the thermal and/or mechanical energy of the feed water input (FW) to partially power the conversion of the feed water input (FW) to the steam output (S). The system (10) further comprises a heat generator arrangement operatively associated with the reactor (12), the heat generator arrangement supplying the remaining thermal energy required to convert the feed water input (FW) into the steam output (S).

5 Claims, 10 Drawing Sheets

(56) References Cited

U.S. PATENT DOCUMENTS

| | | | | |
|---|---|---|---|---|
| 2013/0112394 | A1* | 5/2013 | O'Donnell | F01K 17/04 166/57 |
| 2013/0332130 | A1* | 12/2013 | Loveless | C09K 8/66 703/10 |
| 2014/0144626 | A1 | 5/2014 | Macadam | |
| 2014/0318792 | A1 | 10/2014 | Chen et al. | |
| 2015/0000914 | A1 | 1/2015 | Mandigo et al. | |
| 2015/0041128 | A1* | 2/2015 | Hytken | E21B 43/128 166/57 |
| 2015/0300327 | A1 | 10/2015 | Sweatman et al. | |

* cited by examiner

WATER PROCESSING SYSTEM AND METHOD

CROSS-REFERENCE TO RELATED APPLICATIONS

This application is a continuation of U.S. patent application Ser. No. 16/306,731 filed Dec. 3, 2018, which is the United States national phase of International Application No. PCT/GB2017/051601 filed Jun. 2, 2017, and claims priority to U.S. Provisional Patent Application No. 62/345,139 filed Jun. 3, 2016, the disclosures of which are hereby incorporated in their entirety by reference.

FIELD

The present disclosure relates to a water processing system and method. More particularly, but not exclusively, embodiments of the present disclosure relate to a water processing system and method using water produced by a hydrocarbon reservoir, known as produced water.

BACKGROUND

Many industries require large volumes of energy and/or water in order to operate. While there is a continuing need to meet this and future demand for energy, there is also a desire to increase the use of recycling technologies that reduce industries carbon footprint by better managing the use of hydrocarbons, and hydrocarbon-based products.

In the oil and gas production industry, for example, the desire to increase efficiency and environmental sustainability has seen the development of a number of reservoir stimulation techniques aimed towards increasing the recovery of oil from a given reservoir, known as Enhanced Oil Recovery (EOR), and thereby reduce the overall environmental impact.

In some instances, EOR operations may involve the stimulation of the reservoir by the injection of a gas, e.g. nitrogen or carbon dioxide gas, into the reservoir. In other instances, EOR operations may involve a chemical injection process. In other instances, EOR operations may involve the introduction of heat using steam, this generally known as thermal EOR.

While such techniques have proved successful in increasing the amount of oil that can be recovered, challenges remain with conventional equipment and techniques in terms of their efficiency and environmental impact.

SUMMARY

Aspects of the present disclosure generally relate to a system and method which uses the thermal and/or mechanical energy of a feed water input, such as water produced from a hydrocarbon reservoir, to partially power the conversion of the feed water input to a steam output for use in a downstream operation.

According to a first aspect, there is provided a water processing system comprising:

- a reactor configured to receive a feed water input, the reactor configured to convert said feed water input into a steam output for use in a downstream operation, wherein the water processing system is configured to utilise the thermal and/or mechanical energy of the feed water input to partially power the conversion of the feed water input to the steam output; and

- a heat generator arrangement operatively associated with the reactor, the heat generator arrangement configured to supply the remaining thermal energy required to convert the feed water input into the steam output.

In use, embodiments of the present disclosure are configured to receive a feed water input, such as water from an oil reservoir ("produced water"), and convert this feed water input into a steam output for use in a downstream operation.

In contrast to conventional thermal enhanced oil recovery systems in which the majority of thermal and/or mechanical energy is lost (or in the case of thermal energy purposefully dissipated by cooling as part of the water processing operation), embodiments of the present disclosure utilize the thermal and/or mechanical energy of the produced water in the conversion of the feed water input to the steam output. Thus, in contrast to conventional techniques, embodiments of the present disclosure do not cool the feed water input; rather the feed water is directed to the reactor, the thermal energy of the feed water input and/or the mechanical energy of the feed water input being utilized in the production of the steam output.

Embodiments of the present disclosure provide a number of benefits.

For example, the processing system may be utilized to take in water with high mineral and/or solids content, such as seawater, brackish water and especially heavy oil produced water which may contain entrained oil, and convert this low quality saline water into high pressure de-mineralized steam for enhanced oil recovery operations or to provide purified "new water" for oilfield or other industrial process use.

Embodiments of the present disclosure may also facilitate the processing of saline or contaminated waste water from other oilfield operations such as co-generation blow down, WTP & STP evaporation ponds, fracking operations or sand washing programs which normally render water undesirable for reuse for agriculture, human or wildlife uses or even disposal by deep well injection, reducing the burden on the environment and natural resources.

As described above, the reactor is configured to receive the feed water input, the reactor configured to convert the feed water input into a steam output for use in a downstream operation.

The reactor may be configured to produce a high pressure steam output.

The reactor may be configured to produce a steam output with over 98% vapor content.

The reactor may be configured to produce a steam output with over 99% vapor content.

The reactor may be configured to produce a steam output with over 99.5% vapor content.

The reactor may be configured to produce a steam output of 100% vapor content, or substantially 100% vapor content.

In use, the steam output can be used in a number of applications, including for example re-injection into a hydrocarbon reservoir as part of an enhanced oil recovery operation, for thermal water purification, as a mechanical motivator in a power generation process, or as utility steam for other industrial processes.

As described above, the heat generator arrangement is configured to supply the remaining thermal energy required to convert the feed water input into the steam output.

The heat generator arrangement may be configured to increase the temperature of the feed water input, and thereby convert the feed water input into steam.

The water may enter the reactor at or near to the vaporization temperature. The temperature will be dependent on the process pressure. Additional heat from 5% to 90% of the total needed to make steam at the given pressure may then be supplied.

The heat generator arrangement may be configured to increase the temperature of the feed water input to a temperature at which mineral ions contained within the feed water input, such as dissolved calcium and/or magnesium ions, are precipitated from the feed water input as insoluble salts. By way of example, the temperature may range from 15 psi @ 250 degrees F. to 2500 psi @ 670 degrees F.

The heat generator arrangement may comprise a heat source.

The heat source may be generated from burning fossil fuel. The heat source may, for example but not exclusively, be generated from burning natural gas, waste gas and/or diesel fuel.

The heat source may comprise an electrical heat source.

The heat source may, for example, comprise an electric heater.

In particular embodiments, the heat source may comprise an electric heater powered from the power utility grid or by PV solar cells.

The heat source may also comprise a renewable energy heat source.

The heat source may comprise a concentrated solar power (CSP) thermal source.

The heat source may comprise a geothermal energy source.

The heat source may comprise waste process heat.

As described above, the water processing system is configured to utilize the thermal and/or mechanical energy of the feed water input to partially power the conversion of the feed water input to the steam output The feed water input may comprise water from a single source.

In particular embodiments, the feed water input may comprise water produced from a hydrocarbon reservoir ("produced water").

In other embodiments, the feed water input may comprise a first feed water component from a first source and a second feed water component from a second source.

The first feed water component may comprise the water produced from the hydrocarbon reservoir, for example.

The second feed water component may comprise water from an EOR wellhead separator.

The second feed water component may comprise water from a package boiler blowdown system.

The second feed water component may comprise water from a co-generation blowdown system.

The second feed water component may comprise water from an enhanced oil recovery (EOR) system.

The second feed water component may comprise water from a Heat Recovery Steam Generator (HRSG) system.

The second feed water component may comprise water from a Once Through Steam Generator (OTSG) system.

The second feed water component may comprise condensate from a steam separator.

Alternatively or additionally, the feed water input may comprise waste water.

The reactor may be configured to convert the feed water input into a concentrate output.

The processing system may comprise a closed-loop system.

Beneficially, the provision of a closed-loop system means that harmful to hydrogen sulphide gas is not released to the surrounding atmosphere.

The system may comprise a separator arrangement.

The separator arrangement may comprise a separator configured to receive a water supply, such as untreated produced water from a hydrocarbon reservoir.

The system may comprise a heat exchanger.

The heat exchanger may be coupled to or form part of the reactor.

The heat exchanger may be disposed downstream from the reactor.

The system may comprise a chemical additive supply for adding additives to the feed water.

The system may comprise a chemical additive supply for adding additives to the steam output.

The chemical additives may comprise a polymer. In particular embodiments, the polymer may comprise an EOR polymer.

According to a second aspect, there is provided a water processing method comprising:

providing a water processing system according to the first aspect, the water processing system comprising a reactor configured to receive a feed water input and a heat generator arrangement operatively associated with the reactor; and converting said feed water input to the water processing system into a steam output for use in a downstream operation using the thermal and/or mechanical energy of the feed water input and thermal energy to partially power the conversion of the feed water input to the steam output and using the heat generator arrangement to supply the remaining thermal energy required to convert the feed water input into the steam output.

It should be understood that the features defined above in accordance with any aspect of the present disclosure or below in relation to any specific embodiment of the disclosure may be utilized, either alone or in combination with any other defined feature, in any other aspect or embodiment of the disclosure.

BRIEF DESCRIPTION OF THE DRAWINGS

These and other aspects of the present disclosure will now be described by way of example only with reference to the accompanying drawings, in which:

FIG. 10 shows an enlarged view of the separator of the water processing system shown in FIG. 1A;

DETAILED DESCRIPTION OF THE DRAWINGS

Figure 1A:
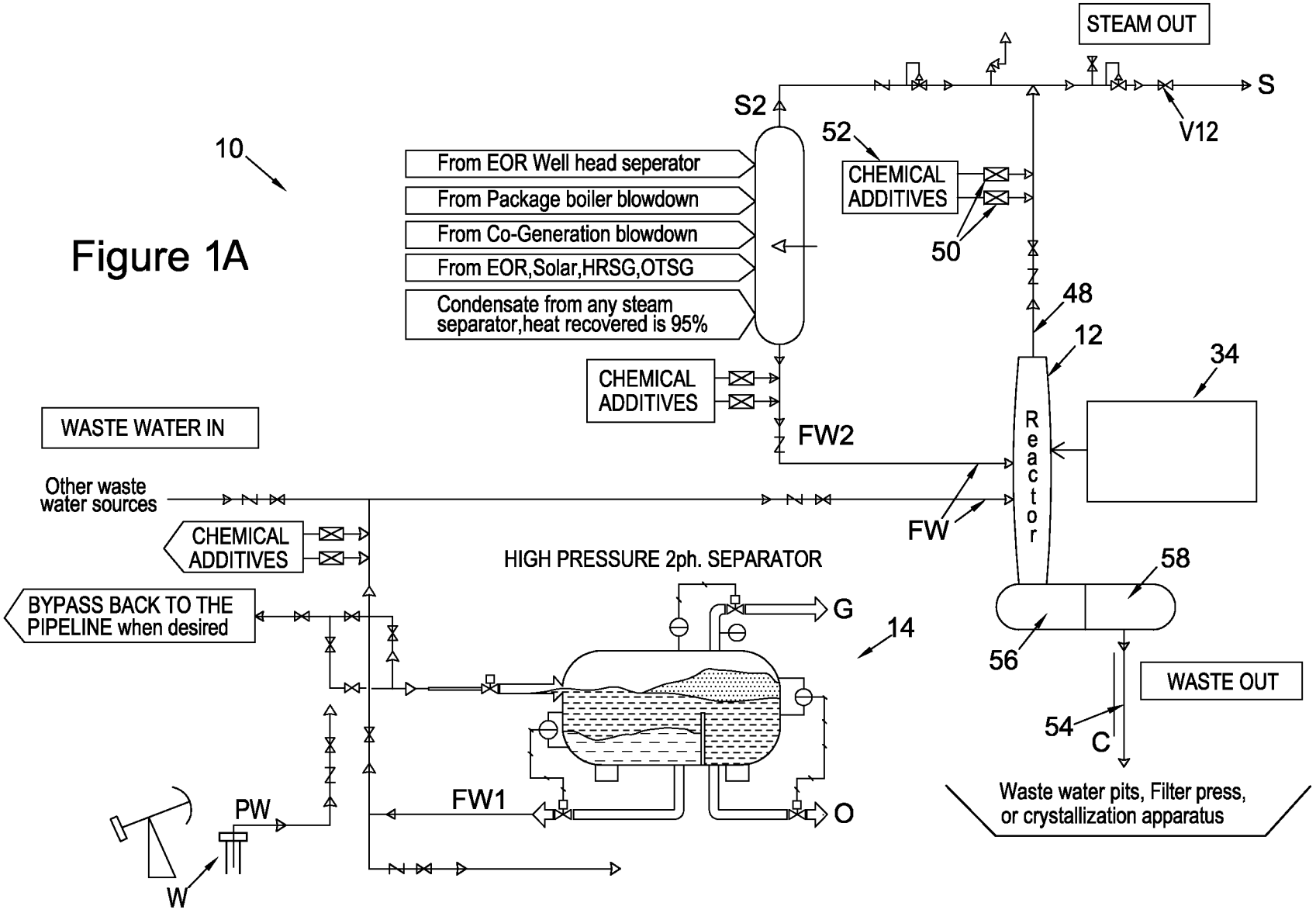
FIG. 1A shows a schematic view of a water processing system according to a first embodiment of the present disclosure.

FIG. 1A of the accompanying drawings shows a schematic view of a water processing system 10 according to a first embodiment of the present disclosure.

As shown in FIG. 1A, the system 10 comprises a reactor 12 configured to receive a feed water input FW and convert this into a steam output S and a concentrate output C. In the illustrated embodiment, the concentrate output C comprises concentrated salts with liquids in the final discharge typically ranging from 0% to 15% of the total fluids and solids input to the system 10.

In the illustrated embodiment, the reactor 12 is configured to produce a steam output S in the form of high pressure 99.8% dry steam. This steam output S can be used in a number of applications, including for example re-injection into a hydrocarbon reservoir as part of an enhanced oil recovery operation, for thermal water purification, as a mechanical motivator in a power generation process, or as utility steam for other industrial processes.

As shown in FIG. 1A, the system 10 comprises a separator arrangement including a separator 14, which in the illustrated embodiment takes the form of a high pressure two phase separator.

In use, the separator 14 receives produced water PW from one or more wells W and separates this into a feed water output FW1 which forms a first part of the feed water input FW to the reactor 12, a gas output G and an oil output O.

Figure 1B:
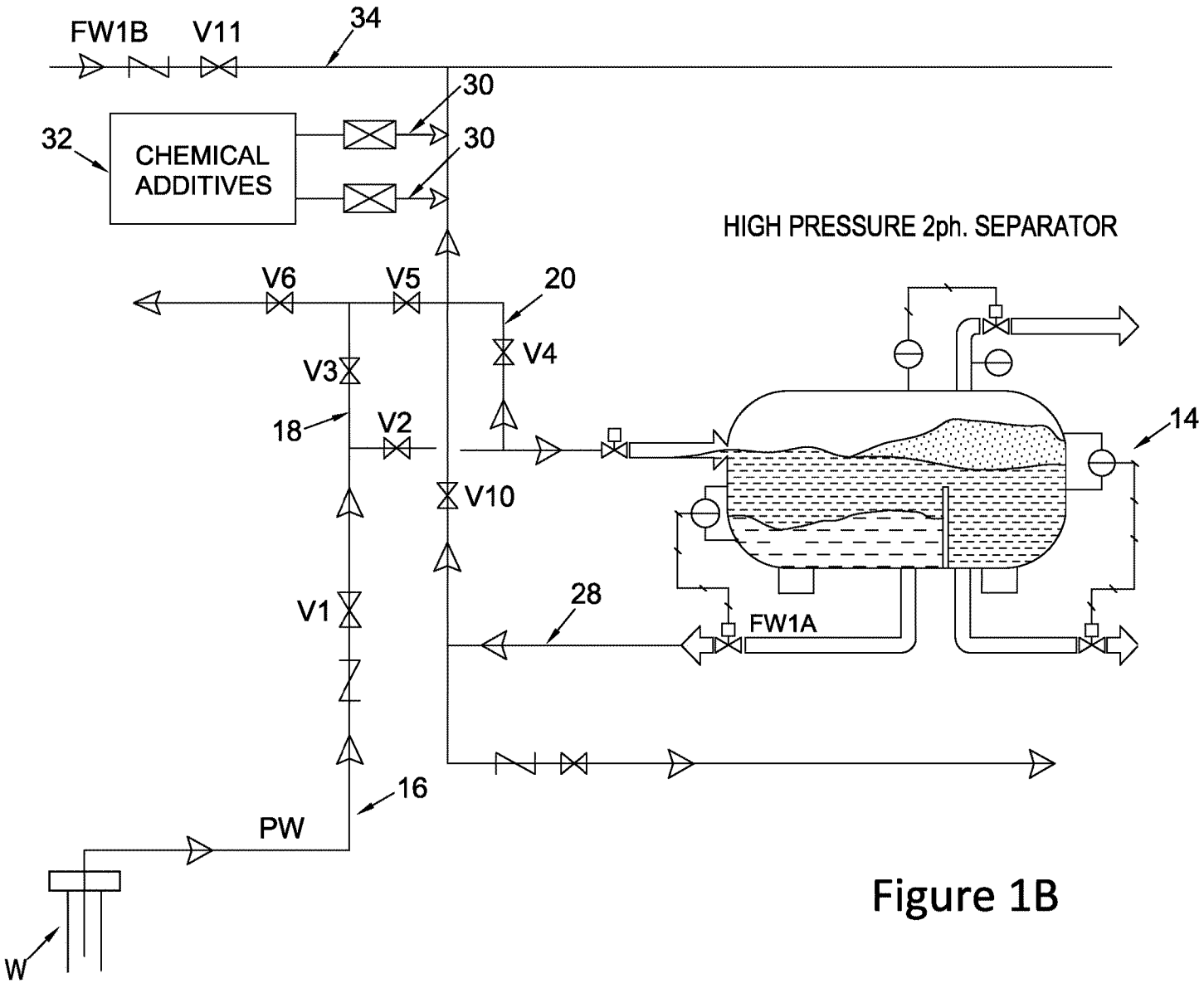
FIG. 1B shows an enlarged view of part of the water processing system shown in FIG. 1A.
Figure 1C:
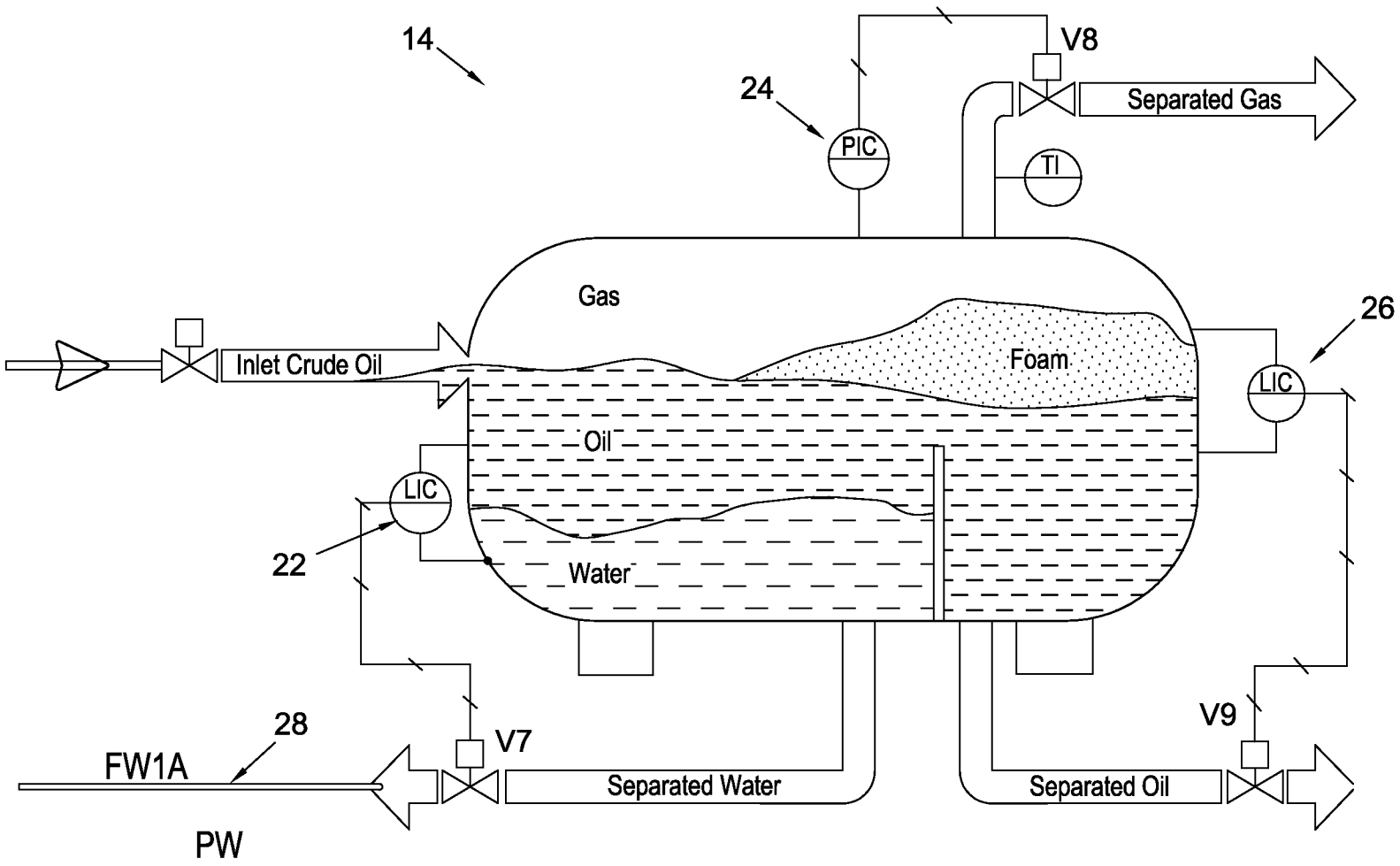
FIG. 1D shows an enlarged view of part of the water processing system shown in FIG. 1A showing a second feed water input component.

FIG. 1B shows an enlarged view of part of the water processing system shown in FIG. 1A.

As shown in FIG. 1B, the separator 14 is coupled to the wells W by a flow line 16. Access to the separator 14 is controlled by control valves V1, V2, V3 and V4. With control valves V1 and V2 open and control valves V3 and V4 closed, the produced water PW from the one or more wells W may be directed to the separator 14.

Bypass lines 18, 20 are provided to selectively direct the produced water PW from the wells W to a pipeline (not shown), where desired.

Access to the bypass lines 18, 20 is controlled by the control valves V3, V4 and also control valves V5 and V6.

FIG. 10 shows an enlarged view of the separator of the water processing system shown in FIG. 1A.

As shown in FIG. 10, the separator 14 includes, is coupled to, or is operatively associated with, a gauge 22 for monitoring the amount of water in the separator 14. The gauge 22 is coupled to a control valve V7.

In use, when the amount of water in the separator 14 detected by the gauge 22 exceeds a selected threshold or as otherwise directed by an operator or control system of the processing system 10, the control valve V7 will open and direct the feed water FW to the reactor 12. Alternatively, if the water is not needed for the process it can be bypassed to the production pipeline (not shown).

The separator 14 includes, is coupled to, or is operatively associated with, a gauge 24 for monitoring the amount of gas in the separator 14. The gauge 24 is coupled to a control valve V8.

In use, when the amount of gas in the separator 14 detected by the gauge 24 exceeds a selected threshold or as otherwise directed by an operator or control system of the processing system 10, the control valve V8 will open. In the illustrated embodiment, the gas G is directed to the reactor 12 and forms part of a heat generation arrangement 34 operatively associated with the reactor 12 described further below. If enough gas is present it will be sent to the process for make-up fuel to supply or augment the heat generator arrangement 34.

The separator 14 includes, is coupled to, or is operatively associated with, a gauge 26 for monitoring the amount of oil in the separator 14. The gauge 26 is coupled to a control valve V9.

In use, when the amount of oil in the separator 14 detected by the gauge 26 exceeds a selected threshold or as otherwise directed by an operator or control system of the processing system 10, the control valve V9 will open so as to direct the oil (and some water) for dehydration or to a production pipeline (not shown). Beneficially, the ability of the system 10 to direct oil back to the production pipeline increases the amount of oil that is recovered from the reservoir.

After leaving the separator 14, the feed water output FW1A from the separator 14 is directed to flow line 28.

As shown, in the illustrated embodiment one or more chemical lines 30 permit chemical additives from chemical store 32 to be added to the feed water component FW1A before it combines with a feed water component FW1B derived from other waste water sources carried by a flow line 34. In the illustrated embodiment, the other sources comprise waste water from one or more upstream process.

While the illustrated embodiment permits the use of feed water FW from both the wells W and the other sources, it will be recognized that the feed water FW may comprise water from the wells W only via flow line 28, from the other sources only or a combination of the wells W and other sources. Beneficially, control valve V10 on flow line 28 and control valve V11 on flow line 34 permit the relative composition of the fed water FW1 to the reactor 12 from the lines 28, 34 to be controlled.

Referring again to FIG. 1A, it can be seen that in addition to, or as an alternative to, the first feed water input component FW1, the reactor 12 receives a second feed water input component FW2.

Figure 1D:
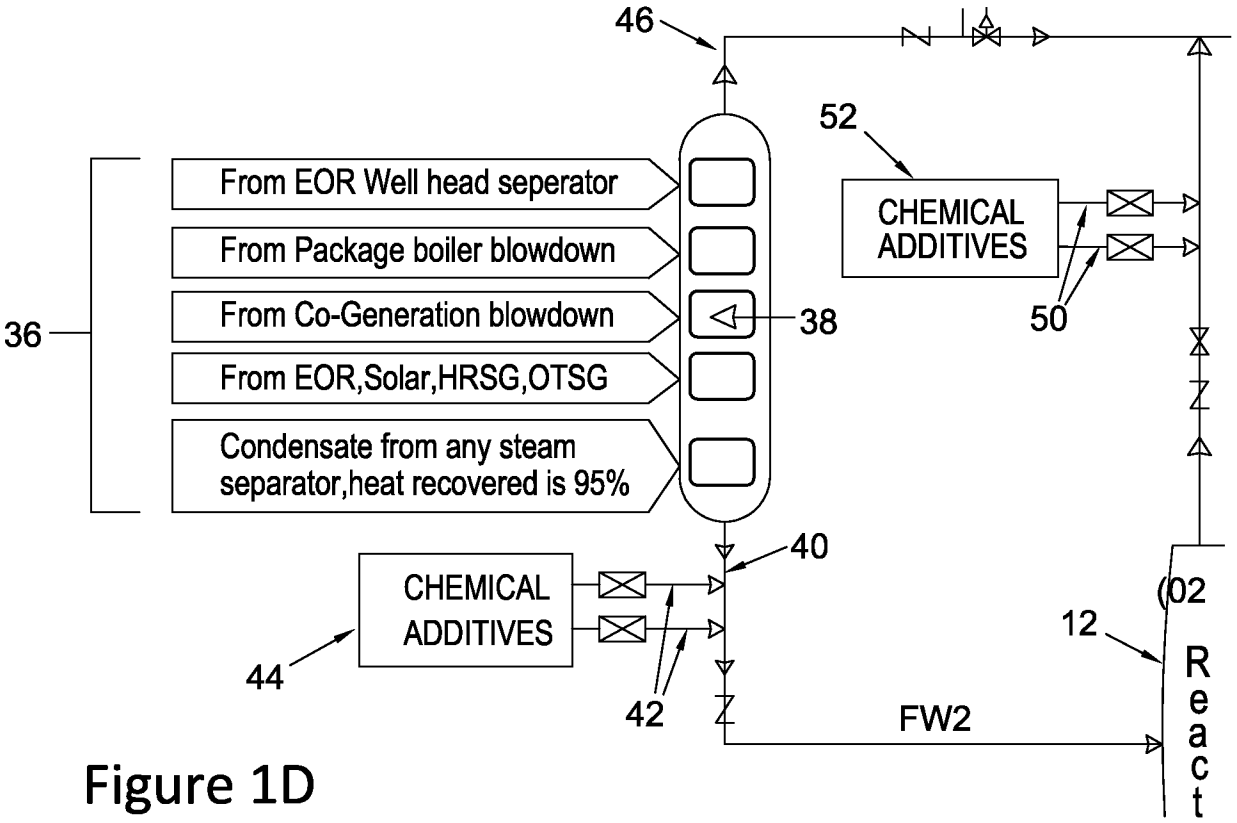

FIG. 1D shows an enlarged view of part of the processing system 10 showing the second feed water input component FW2.

As shown in FIG. 1D, the second feed water input component FW2 comprises hot water and/or condensate from a number of sources, or combination of sources 36. For example, in the illustrated embodiment the second feed water input component FW2 comprises hot water and/or condensate from: an EOR wellhead separator; a package boiler blowdown; a co-generation blowdown; an EOR system; a solar system; a Heat Recovery Steam generator (HRSG); a Once Through Steam Generator (OTSG); and/or a steam separator. Each source 36 may be operatively associated with a process separator—collectively represented in FIG. 1A by reference 38—with the outputs from the separators 38 combined in a similar manner to that described above with reference to the separator 14. It will be recognized that in some embodiments, a single separator 38 may be provided for all of the sources 36.

The separator 38 is coupled to the reactor 12 by flow line 40. A control valve (not shown) may control access between the separators 38 and the reactor 12 and permit metering of the relative composition of the feed water component FW1 and feed water component FW2 to the reactor 12.

As shown, in the illustrated embodiment one or more chemical lines 42 permit chemical additives from chemical store 44 to be added to the feed water component FW2 before it is directed to the reactor 12.

In use, the feed water input component FW2 provides water to the reactor 12 at high pressure, reducing the demands on the reactor 12.

A flow line 46 directs a steam output S2 from the separator 38, which is comingled the steam output S from the reactor 12.

As described above, the reactor 12 is operable to convert the feed water FW (from feed water component FW1 and/or feed water component FW2) into a steam output S for use in a downstream operation and a concentrate output C and as shown in FIG. 1A, the reactor 12 comprises, is coupled to, or is operatively associated with a heat generator 34.

In use, the heat generator 34 supplies the additional energy required to convert the feed water FW into the required high pressure steam output S.

In the illustrated embodiment, the heat generator 34 transfers heat from a secondary liquid heat transfer medium comprising molten salt. However, embodiments of the present disclosure beneficially permit the use of any suitable heat source as the heat generator 34, including for example but not exclusively: a fossil fuel burner; an electrical generator; a concentrated solar power (CSP) thermal source; a solar source; a geothermal source; a waste process heat source or the like, or a combination of these.

In use, the reactor 12 is configured to increase the temperature of the feed water FW by increasing the temperature of the feed water FW to a temperature at which mineral ions, e.g. calcium and magnesium ions, contained within the water input are precipitated as insoluble salts.

In the illustrated embodiment, the reactor 12 produces high pressure 99.8% dry steam. The demineralized high pressure saturated steam is used directly for a downstream process, such as EOR re-injection, thermal water purification, power generation processes or as a mechanical motivator in a utility steam application.

As shown in FIG. 1A, a flow line 48 is provided for directing the generated steam S from the reactor 12 from the system 10. The steam flow S is controlled by control valve V12.

One or more chemical lines 50 permit chemical additives to be added from chemical store 52 to the steam output S from the reactor 12. In the illustrated embodiment, the additives comprise EOR polymers. However, it will be recognized that other suitable chemical additives may be used or no chemical additives may be added to the steam output S.

Flow line 54 is provided to direct the concentrate output C from the reactor 12 to the system outlet, e.g. a waste water pit, a filter press or crystallization apparatus. Fluid with a percentage of concentrated salts less than 10% of the total composition may be contained for further processing or, where appropriate, may be sent to the production pipeline (not shown).

In the illustrated embodiment, the reactor 12 comprises, is coupled to, or is operatively associated with a solids separator 56 and a heat exchanger 58. The solids separator 56 and heat exchanger 58 are disposed between the reactor 12 and the concentrate outlet. In use, the solids separator 56 is operable to filter the concentrate output C while the heat exchanger 58 is operable to recover thermal energy from the concentrate output C, e.g. for use in the reactor 12.

In use, after initial de-oiling takes place the system 10 uses untreated high solids and salts & slightly oily water directly. The process completely de-couple's the balance of plant used for conventional produced water pre-treatment processes.

Since the system is capable of providing an all-in-one, closed loop process, significant capital expenditure savings can be achieved.

Moreover, the process reduces the burden on the environment and natural resources, with less clean water used, less carbon pollution expelled to the air, zero carbon emissions, and reduced electrical power consumption.

As described above, conventional systems suffer from a number of drawbacks. For example, for a typical thermal enhanced oil recovery field, most of the thermal energy injected into the oil reservoir is wasted; in the case of a reservoir subject to a Cyclic Steam Stimulation (CSS) operation, it has been found that around 30-60% of the thermal energy injected into the reservoir is pumped back out in the first 30 days.

Embodiments of the present disclosure use nearly all of the wasted thermal and mechanical energy lost in conventional thermal EOR processes, especially thermal energy of the produced water which is usually cooled before the required re-processing needed for the conventional produced water treatment processes.

Beneficially, the processing system 10 utilizes the thermal energy from the feed water FW1, e.g. hot produced flow back water and some oil, as well as the mechanical energy of the feed water FW1 provided by the high pressure downhole pump used to transport the produced water PW to surface. In this way, the downhole pump can be utilized to feed the reactor 12 at a small incremental cost, and without the requirement to provide additional feed water pumps high pressure pumps at surface. This results in simpler operations and reduced electrical energy consumption.

Other feed water sources can also be processed, converted to usable water for commercial or agricultural demands.

The process reactor processes at high temperature. Thus, multiple unconventional water sources can be processed, such as sewage, since biological poisons & bacterial waste can be neutralized by the high temperature.

Figure 2A:
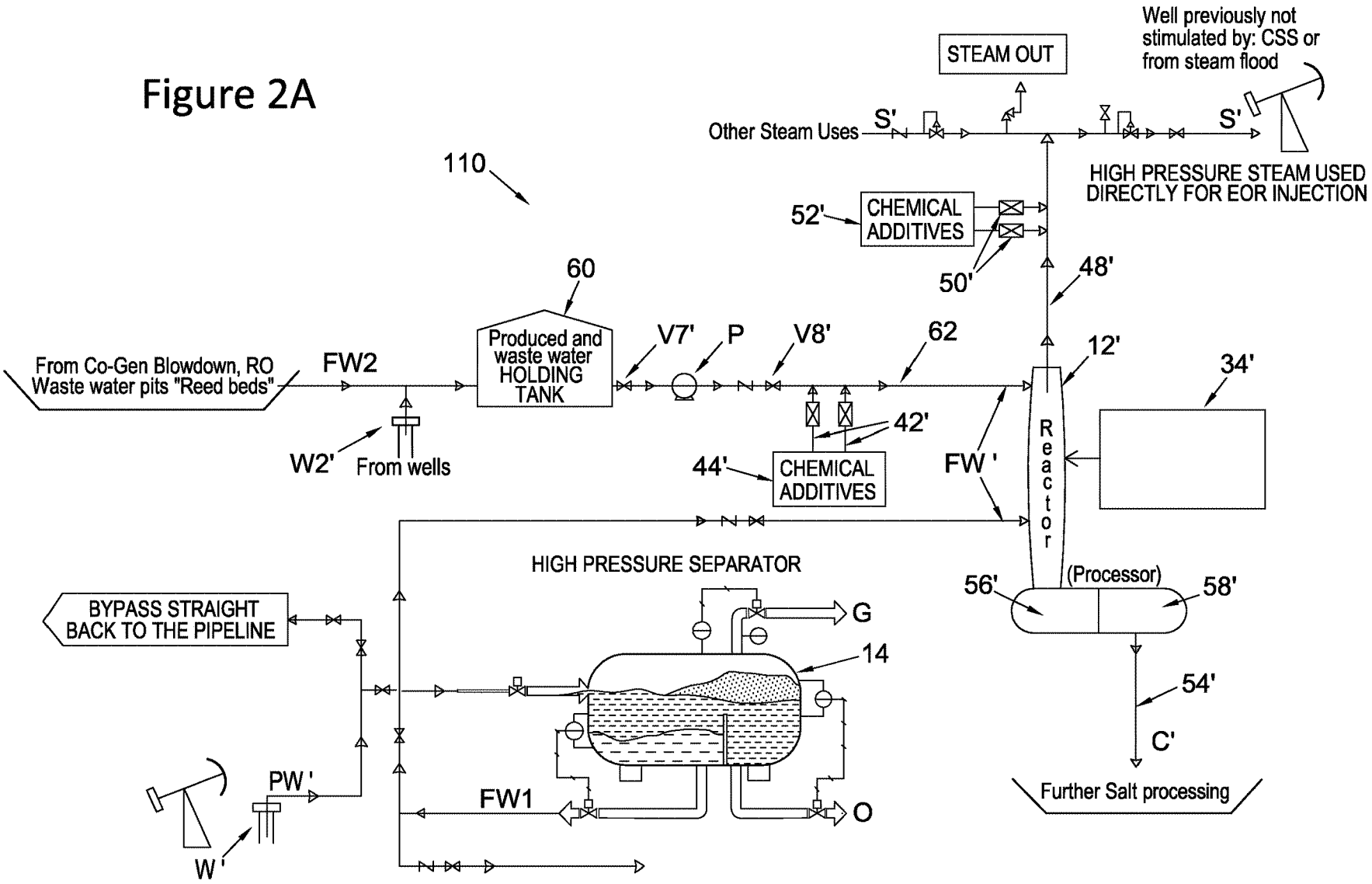
FIG. 2A shows a schematic view of a water processing system according to a second embodiment of the present disclosure.

FIG. 2A of the accompanying drawings shows a schematic view of a water processing system 110 according to a second embodiment of the present disclosure.

As shown in FIG. 2A, the system 110 comprises a reactor 12' configured to receive a feed water input FW' and convert this into a steam output S' and a concentrate output C'.

In the illustrated embodiment, the reactor 12' is configured to produce a steam output S' in the form of high pressure 100% dry steam. In the illustrated embodiment, this steam output S' is split, one stream being used directly for EOR reinjection (in particular but not exclusively into a well not previously stimulated by a CSS or steam flood EOR process and another stream being used other steam uses.

As shown in FIG. 2A, the system 110 comprises a separator arrangement including a separator 14', which in the illustrated embodiment takes the form of a high pressure two phase separator.

In use, the separator 14' receives produced water PW' from one or more wells W' and separates this into a feed water output FW1 which forms a first part of the feed water input FW' to the reactor 12', a gas output G' and an oil output O'.

Figure 2B:
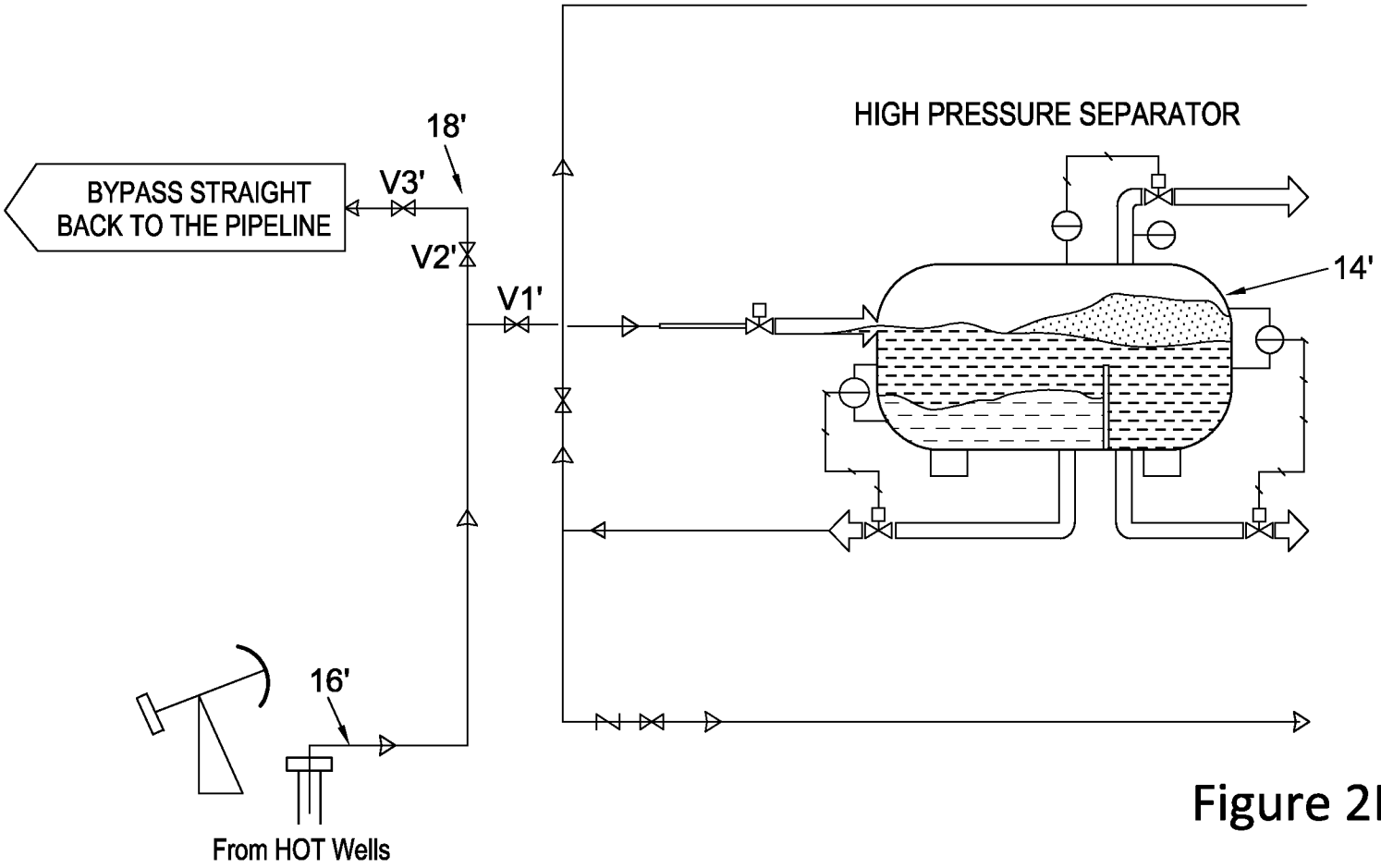
FIG. 2B shows an enlarged view of part of the water processing system shown in FIG. 2A.

FIG. 2B shows an enlarged view of part of the water processing system 110 shown in FIG. 2A.

As shown in FIG. 2B, the separator 14' is coupled to the wells W' by a flow line 16'. Access to the separator 14' is controlled by control valves V1', V2'. With control valves V1' open and V2' closed, the produced water PW' from the one or more wells W' may be directed to the separator 14'.

Bypass line 18' is provided to selectively direct the produced water PW' from the wells W' to a pipeline (not shown), where desired.

Access to the bypass line 18' is controlled by the control valve V2' and also control valve V3'. With control valve V1' closed and valves V2' and V3' open, the produced water PW' from the one or more wells W' may be directed via the bypass line 18' rather than to the separator 14'.

Figure 2C:
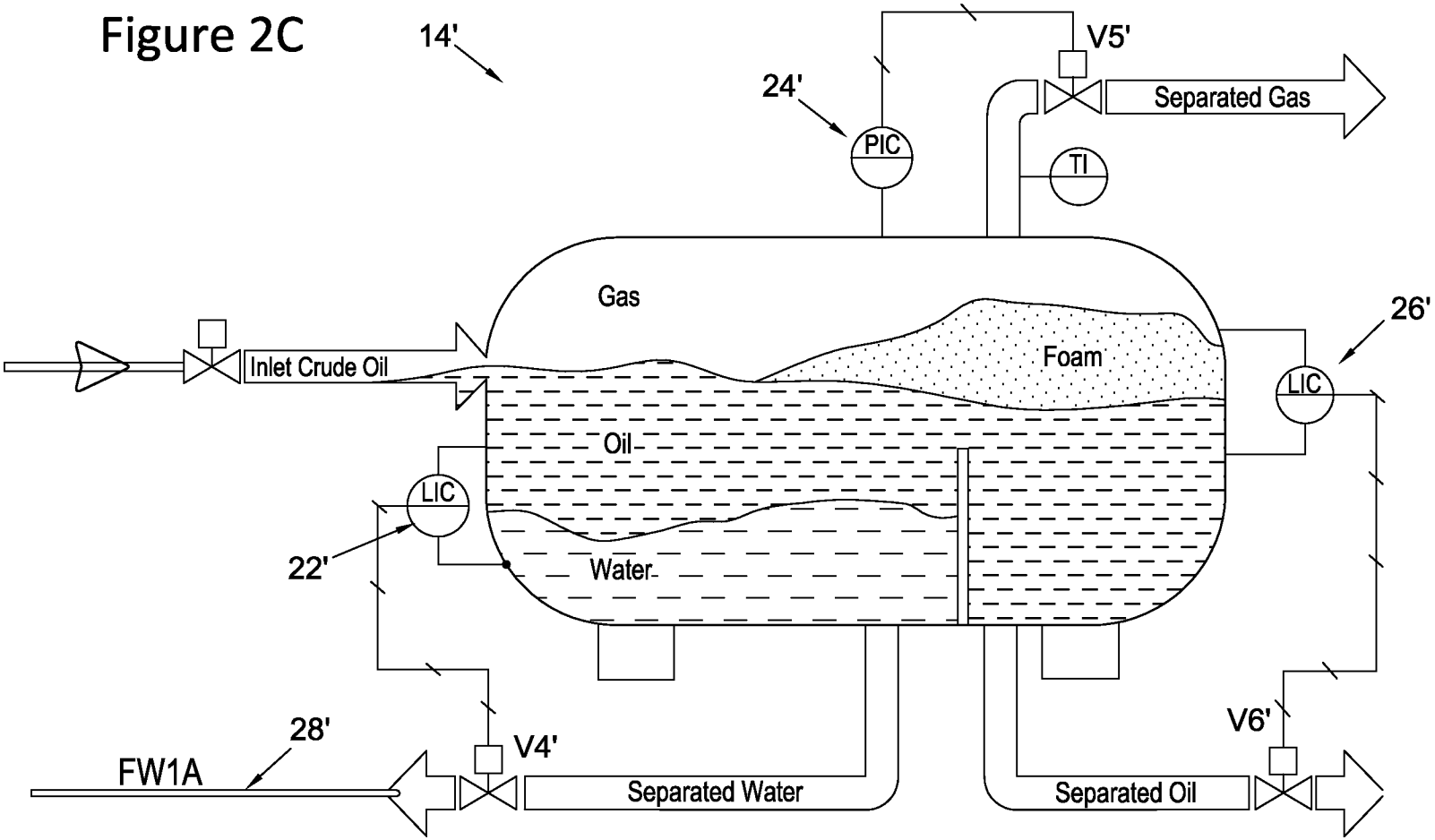
FIG. 2C shows an enlarged view of the separator of the water processing system shown in FIG. 2A.

FIG. 2C shows an enlarged view of the separator 14' of the water processing system 110 shown in FIG. 2A.

As shown in FIG. 2C, the separator 14' includes, is coupled to, or is operatively associated with, a gauge 22' for monitoring the amount of water in the separator 14'. The gauge 22' is coupled to a control valve V4'.

In use, when the amount of water in the separator 14' detected by the gauge 22' exceeds a selected threshold or as otherwise directed by an operator or control system of the processing system 110, the control valve V4' will open and direct the feed water FW1' to the reactor 12'. Alternatively, if the water is not needed for the process it can be bypassed to the production pipeline (not shown).

The separator 14' includes, is coupled to, or is operatively associated with, a gauge 24' for monitoring the amount of gas G' in the separator 14'. The gauge 24' is coupled to a control valve V5'.

In use, when the amount of gas in the separator 14' detected by the gauge 24' exceeds a selected threshold or as otherwise directed by an operator or control system of the processing system 110, the control valve V5' will open.

In the illustrated embodiment, the gas G' is directed to the reactor 12' and forms part of a heat generation arrangement 34' operatively associated with the reactor 12' described further below. Where not required as part of the heat generation arrangement, the gas G' will instead be directed to the production pipeline.

The separator 14' includes, is coupled to, or is operatively associated with, a gauge 26' for monitoring the amount of oil 0' in the separator 14'. The gauge 26' is coupled to a control valve V6'.

In use, when the amount of oil 0' in the separator 14' detected by the gauge 26' exceeds a selected threshold or as otherwise directed by an operator or control system, the control valve V6' will open so as to direct the oil 0' (and some water) for dehydration or to the production pipeline (not shown). Beneficially, the ability of the system 110 to direct the oil 0' back to the production pipeline increases the amount of oil that is recovered from the reservoir.

After leaving the separator 14', the feed water component FW1' from the separator 14' is directed to flow line 28'.

As shown in FIG. 2A, it can be seen that in addition to, or as an alternative to, the feed water FW1', the reactor 12' receives a second feed water component FW2'.

In the illustrated embodiment, the feed water component FW2' utilizes produced water from other wells W2' and other sources, e.g. a co-generation blowdown, a reverse osmosis (RO) waste water pit, a reed bed, or the like, or a combination of these.

As shown in FIG. 2A, a holding tank 60 is provided to store the feed water FW2'. Flow from the holding tank 60 to the reactor 12' is controlled by control valves V7', V8', a pump P and flow line 62.

As shown, in the illustrated embodiment one or more chemical lines 42' permit additives from chemical store 44' to be added to the feed water component FW2' before it is directed to the reactor 12'.

As described above, the reactor 12' is operable to convert the feed water FW' (from feed water FW1' and/or feed water FW2') into a steam output S' and a concentrate output C'.

As shown in FIG. 2A, the reactor 12' comprises, is coupled to, or is operatively associated with a heat generator 34'. In use, the heat generator 34' supplies the additional energy required to convert the feed water FW' into the required high pressure steam output S'.

In the illustrated embodiment, the heat generator 34' transfers heat from a secondary liquid heat transfer medium comprising molten salt. However, embodiments of the present disclosure beneficially permit the use of any suitable heat generator as the heat generator 34', including for example but not exclusively: a fossil fuel burner; an electrical generator; a concentrated solar power (CSP) thermal, source; a solar source; a geothermal source; a waste process heat or the like, or combinations of these.

In use, the reactor 12' is configured to increase the temperature of the feed water FW' by increasing the temperature of the feed water FW' to a temperature at which mineral ions, e.g. calcium and magnesium ions, contained within the water input are precipitated as insoluble salts.

In the illustrated embodiment, the reactor 12' produces high pressure 100% dry steam. This demineralized high pressure saturated steam is used directly for a downstream process, such as EOR re-injection in a well not previously subject to a thermal EOR, e.g. CSS or steam flood, operation.

A flow line 48' is provided for directing the generated steam from the reactor 12' from the processing system 110.

As shown, one or more chemical lines 50' permit chemical additives from chemical store 52' to be added to the steam output S'. In the illustrated embodiment, the additives comprise EOR polymers. However, it will be recognized that other suitable chemical additives may be used or no chemical additives may be added to the steam output S'.

A flow line 48' is provided for directing the generated steam from the reactor 12''' from the processing system 110.

Flow line 54' is provided to direct the concentrate output C' from the reactor 12' to the system outlet. In this embodiment, the concentrate output C' is directed for further salt processing.

As in the first embodiment, in the illustrated embodiment shown in FIG. 2A the reactor 12' comprises, is coupled to, or is operatively associated with a solids separator 56' and a heat exchanger 58'. The solids separator 56' and heat exchanger 58' are disposed between the reactor 12' and the concentrate outlet. In use, the solids separator 56' is operable to filter the concentrate output C' while the heat exchanger 58' is operable to recover thermal energy from the concentrate output C'.

The second embodiment provides the same benefits as the first embodiment.

For example, the system 110 use nearly all of the wasted thermal and mechanical energy lost in conventional thermal EOR processes, especially thermal energy of the produced water which is usually cooled before the required re-processing needed for the conventional produced water treatment processes.

Beneficially, the processing system 110 utilizes the thermal energy from the feed water FW1, e.g. hot produced flow back water and some oil, as well as the mechanical energy of the feed water FW1' provided by the high pressure downhole pump used to transport the produced water PW to surface. In this way, the downhole pump can be utilized to feed the reactor 12' at a small incremental cost, and without the requirement to provide additional feed water pumps high pressure pumps at surface. This results in simpler operations and reduced electrical energy consumption.

Other feed water sources can also be processed, converted to usable water for commercial or agricultural demands.

The process reactor processes at high temperature. Thus, multiple unconventional water sources can be processed, such as sewage, since biological poisons & bacterial waste can be neutralized by the high temperature.

In this embodiment, the system 110 facilitates a mechanical energy and waste heat recovery process to "leap frog" from well-to-well, that is utilizing the energy from produced water from a previous thermal EOR process in a new well stimulation operation.

In use, after the first well is steamed, all of the thermal energy is stored in the oil reservoir. As much as 30-60% of the thermal energy injected is pumped back out in the first 30 days. The system 110 will use all of this energy to save fuel for the next 30 day injection cycle.

Figure 3A:
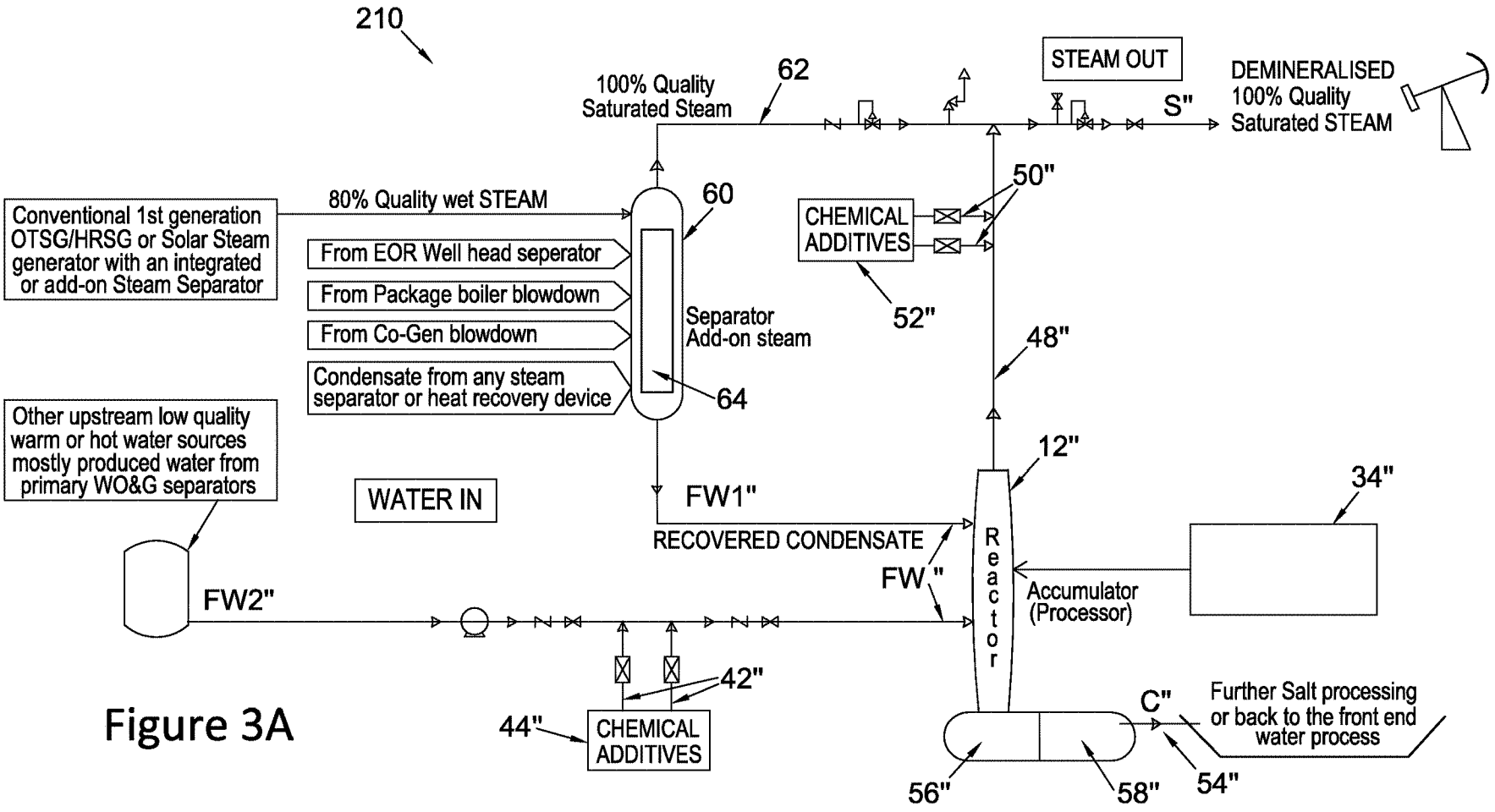
FIG. 3A shows a schematic view of a water processing system according to a third embodiment of the present disclosure.

FIG. 3A shows a schematic view of a water processing system 210 according to a third embodiment of the present disclosure.

As shown in FIG. 3A, the system 210 comprises a reactor 12" configured to receive a feed water input FW" and convert this into a steam output S" and a concentrate output C".

In the illustrated embodiment, the reactor 12" is configured to produce a steam output S" in the form of high pressure 100% dry steam. This steam output S" can be used in a number of applications, including for example re-injection into a hydrocarbon reservoir as part of an enhanced oil recovery operation, for thermal water purification, as a mechanical motivator in a power generation process, or as utility steam for other industrial processes.

Figure 3B:
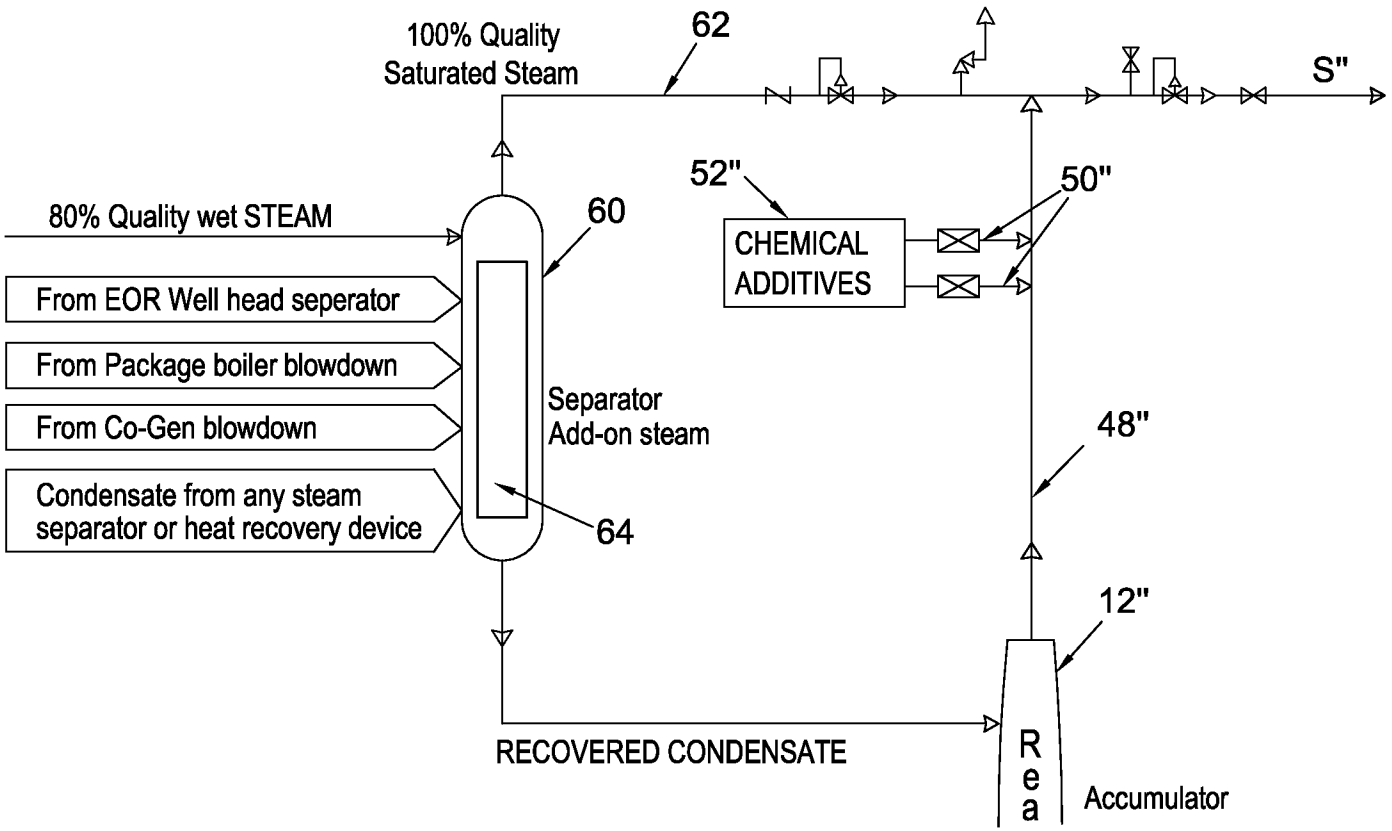
FIG. 3B shows an enlarged view of part of the water processing system shown in FIG. 3A.

FIG. 3B shows an enlarged view of part of the processing system shown in FIG. 3A.

As shown in FIG. 3B, the system 210 further comprises a steam generator 60 which in the illustrated embodiment comprises a conventional Once Through Steam Generator (OTSG), Heat Recovery Steam Generator (HRSG) or Solar steam generator. The steam generator 60 receives 80% quality wet steam. In use, the steam generator 60 is configured to provide a steam output of 100% saturated steam which can be comingled with the steam output S" via flow line 62.

The steam generator 60 is coupled to, formed with, and/or operatively associated with a separator arrangement comprising a steam separator 64. In the illustrated embodiment, the steam separator 64 is integral to steam generator 60.

The steam generator 60 and steam separator 64 are coupled to the reactor 12", with concentrate from the separator 64 providing the feed water input FW1" to the reactor 12".

In addition to, or as an alternative to, the feed water FW1", the reactor 12" receives a second feed water input FW2". In the illustrated embodiment, the feed water FW2 comprises water from any upstream low quality warm or hot water source. In particular, but not exclusively, the feed water FW2" may comprise produced water from one or more primary stage oil and gas separators, such as the separator 14 described above.

As shown, in the illustrated embodiment one or more chemical lines 42" permit additives from chemical store 44" to be added to the feed water component FW2 before it is directed to the reactor 12".

As in previous embodiments, the reactor 12" is operable to convert the feed water FW (from feed water FW1 and/or feed water FW2) into a steam output S" and a concentrate output C".

As shown in FIG. 3A, the reactor 12" comprises, is coupled to, or is operatively associated with a heat generator 34". In use, the heat generator 34" supplies the additional energy required to convert the feed water FW" into the required high pressure steam output S'.

In the illustrated embodiment, the reactor 12" is configured to produce a steam output S' in the form of high pressure 99.8% dry steam. In the illustrated embodiment, this steam output S' is split, one stream being used directly for EOR reinjection (in particular but not exclusively into a well not previously stimulated by a CSS or steam flood EOR process and another stream being used other steam uses.

In the illustrated embodiment, the heat generator 34" transfers heat from a secondary liquid heat transfer medium comprising molten salt. However, embodiments of the present disclosure beneficially permit the use of any suitable heat generator as the heat generator 34", including for example but not exclusively: a fossil fuel burner; an electrical generator; a concentrated solar power (CSP) thermal, source; a solar source; a geothermal source; a waste process heat or the like, or combinations of these.

In use, the reactor 12" is configured to increase the temperature of the feed water FW" by increasing the temperature of the feed water FW" to a temperature at which mineral ions, e.g. calcium and magnesium ions, contained within the water input are precipitated as insoluble salts.

One or more chemical lines 50" permit chemical additives from chemical store 52" to be added to the steam output S". In the illustrated embodiment, the additives comprise EOR polymers. However, it will be recognized that other suitable chemical additives may be used or no chemical additives may be added to the steam output S".

A flow line 48" is provided for directing the generated steam from the reactor 12'" from the processing system 210.

Flow line 54" is provided to direct the concentrate output C" from the reactor 12" to the system outlet, e.g. further salt processor or back to the front end water process.

In the illustrated embodiment, the reactor 12" comprises, is coupled to, or is operatively associated with a solids separator 56" and a heat exchanger 58". The solids separator 56" and heat exchanger 58" are disposed between the reactor 12" and the concentrate outlet. In use, the solids separator 56" is operable to filter the concentrate output C" while the heat exchanger 58" is operable to recover thermal energy from the concentrate output C".

The system 210 facilitates a "top-up" energy and waste heat recovery process. The process takes high pressure condensate with nearly enough heat to make steam at a slightly higher pressure. The process tops-up the heat with sufficient thermal input to enable the reactor to produce demineralized steam into the downstream process, recovering all the heat in the condensate whilst separating out the solids for further processing.

The process uses all the condensate from upstream processes plus any low quality brine, brackish, oily or mixed with any organic carbons as make up water.

Most EOR produced make-up water is hot, retaining most of the energy needed to make high pressure steam.

Particular applications include use at a wellhead to directly top up steam that has been distributed a long way and condensed somewhat.

Figure 4:
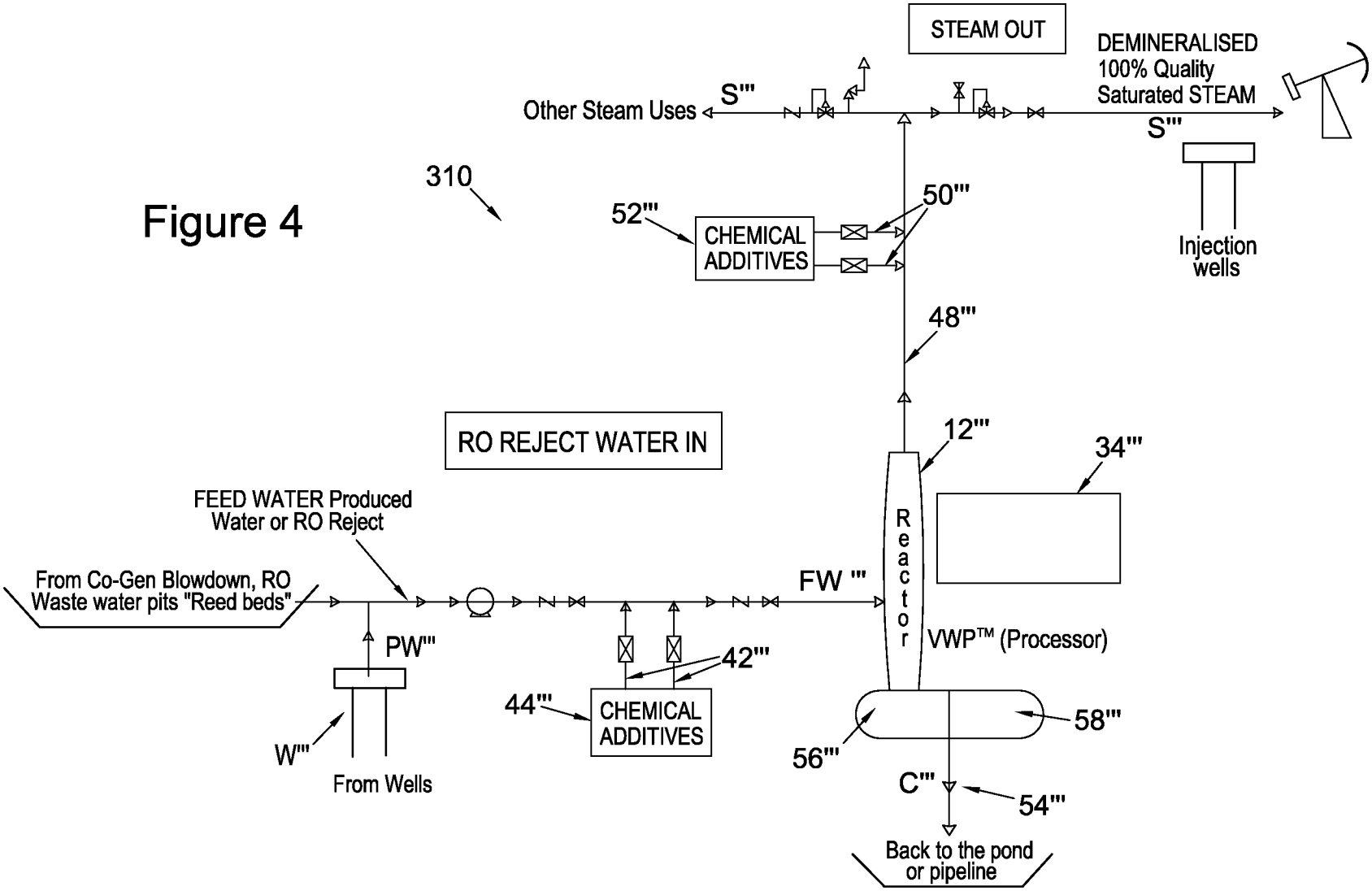
FIG. 4 shows a schematic view of a water processing system according to a third embodiment of the present disclosure.

FIG. 4 shows a schematic view of a water processing system 310 according to a third embodiment of the present disclosure.

As shown in FIG. 4, the system 310 comprises a reactor 12''' configured to receive a feed water input FW''' and convert this into a steam output S''' and a concentrate output C'''.

In the illustrated embodiment, the reactor 12''' is configured to produce a steam output S''' in the form of high pressure 100% dry steam. In the illustrated embodiment, this steam output 5''' is split, one stream being used directly for EOR re-injection and another stream being used other steam uses.

In the illustrated embodiment, the feed water FW''' utilizes produced water PW''' from one or more wells W''' and other sources, e.g. a co-generation blowdown, a reverse osmosis (RO) waste water pit, a reed bed or the like.

As shown, in the illustrated embodiment one or more chemical lines 42''' permit additives from chemical store 44''' to be added to the feed water component FW''' before it is directed to the reactor 12'''.

The reactor 12''' is operable to convert the feed water FW''' into a steam output S''' and a concentrate output C'''.

As shown in FIG. 4, the reactor 12''' comprises, is coupled to, or is operatively associated with a heat generator 34'''. In use, the heat generator 34''' supplies the additional energy required to convert the feed water FW''' into the required high pressure steam output C'''.

In the illustrated embodiment, the heat generator 34''' transfers heat from a natural gas source, a diesel source, a waste gas or the like. However, embodiments of the present disclosure beneficially permit the use of any suitable heat generator as the heat generator 34''', including for example but not exclusively: a fossil fuel burner; an electrical generator; a concentrated solar power (CSP) thermal, source; a solar source; a geothermal source; a waste process heat or the like, or combinations of these.

In use, the reactor 12''' is configured to increase the temperature of the feed water FW''' by increasing the temperature of the feed water FW''' to a temperature at which mineral ions, e.g. calcium and magnesium ions, contained within the water input are precipitated as insoluble salts.

A flow line 48''' is provided for directing the generated steam from the reactor 12''' from the processing system 310.

As shown, one or more chemical lines 50''' permit chemical additives from a chemical store 52''' to be added to the steam output S'''. In the illustrated embodiment, the additives comprise EOR polymers. However, it will be recognized that other suitable chemical additives may be used or no chemical additives may be added to the steam output S'''.

Flow line 54''' is provided to direct the concentrate output C''' from the reactor 12''' to the system outlet. In this embodiment, the concentrate output C''' is directed to a pond or pipeline.

As in the first embodiment, in the illustrated embodiment shown in FIG. 4 the reactor 12''' comprises, is coupled to, or is operatively associated with a solids separator 56''' and a heat exchanger 58'''. The solids separator 56''' and heat exchanger 58''' are disposed between the reactor 12''' and the concentrate outlet. In use, the solids separator 56''' is operable to filter the concentrate output C''' while the heat exchanger 58''' is operable to recover thermal energy from the concentrate output C'''.

Embodiments of the present disclosure provide a number of technical advantages over conventional equipment, including:—

1. The system takes very hot water directly to the reactor which has a heat content very close to the steam vaporization temperature and converts the hot condensate into steam with a small amount of energy input, the vaporization pressure is increased sufficiently for recycling into the steam system;
2. the system uses common low cost carbon steel materials throughout;
3. chemical additives and modern automation eliminate the risk of adverse scale deposition within the system;
4. the system separates virtually all the unwanted minerals that foul downstream processes; these minerals are then concentrated for further low cost processing;
5. the system's use of molten salt heat transfer fluid lowers the heat flux below scaling levels;
6. due to the system's use of molten salt heat transfer mechanism, the system is adaptable to 100% solar generated heat by adding on commercially available CSP (solar) systems which can be phased in in modules without modification or interruption to the existing system;
7. the ability to utilize differential & hydraulic mechanical pressure can eliminate the need for some external pump systems, thus saving energy and overall complexity;
8. jet pumps can be used to boost hydraulic pressure, resulting in a reduction in rotating equipment which in turn reduces O&M requirements, improves HSE risk, and reduces electrical power consumption; and
9. a cyclone separator may be used, enhanced by injecting the high concentration brine rejected from the process; the brine makes the water phase heavier with the brine solids oil & water separation using the cyclonic action works more efficiently.

Embodiments of the present disclosure also provide the following additional advantages, including:—

1. the system is environmentally proactive, protects water resources, air quality and fuel better used in other processes;
2. the system solves a good portion of Oil & Gas produced water management problem;
3. the system is a key enabler for newly introduced low salinity steam & water flood processes;
4. the system saves fuel, water, chemicals & a considerable amount of rotation equipment thereby reducing holistic upstream electrical, manufacturing and manpower cost of the process;
5. the system reduces total O&M requirements improving asset uptime and & further improving the human HSE risk profile;
6. the system can be remotely monitored and or operated, and so is suitable for use in dangerous or remote operational areas;
7. reduced electrical power consumption enables the system to generate its own electrical power using off-the-shelf steam dynamos to achieve zero external electrical power to operate;
8. the use of a solar kiln to further dry the salts can now be applied effectively;
9. the use of molten salt heat transfer media improves the HSE profile of the system and decreases the potential for a negative environmental impact and/or fire in the case of a heat transfer fluid spill;
10. the steam output is ideally suited for use in other technologies that require the use of distilled high-pressure laboratory quality, saturated steam to effectively enable complimentary processes such as smart water polymers, surface tension reducers and can be a key enabler for the low salinity steam process;

11. the system is fit-for-purpose for large scale thermal desalination water purification projects;
12. the system can be completely operated off grid powered by renewable sources 24 hours a day and 7 days a week; and
13. the applicability of the system extends to industrial uses or electrical power generation or as the engine for a large-scale thermal desalination water purification projects.

Embodiments of the present disclosure can also be seen to make the following additional contribution over conventional techniques and equipment, including:—

1. the system produces 99.9% saturated steam delivering the maximum heat content to the oil reservoirs below the ground;
2. the dryer steam as a single phase is better suited for distribution through pipelines to injector wells;
3. the mechanical energy & heat recovered from ongoing thermal EOR activities is transferred directly into the system; no intermediate treatment process is required for reuse in the EOR re-injection cycle;
4. the steam output (e.g. distilled high-pressure laboratory quality saturated steam) is a key enabler, used in conjunction with a range of other "complementary technologies and innovations;
5. the steam output if fully de-mineralized protects the oil reservoir from solids build-up;
6. the system has a higher heat enthalpy than conventional systems, delivering more heat to the oil reservoir for the same energy input;
7. the system increases asset operational life and safety through embedding more effective operational and reducing substantially the number of moving components in the process;
8. the system saves fuel and is capable of a zero carbon footprint, and can be fitted with carbon capture technology if supplemental hydrocarbon fuels are needed;
9. the system can recycle oilfield produced or other processed wastewater directly to be re-injected into subsurface oil formations, to enhance oil recovery saving energy and investment cost of additional equipment;
10. the system can be used to concentrate and recover water from hydrocarbon infused saline brine water for further commercial applications;
11. the system can produce a 100% or substantially 100% demineralized high pressure steam output;
12. the system can use ocean or brackish and contaminated water as primary feed or as a supplementary water source;
13. the system does not require frequent manual batch cleaning to handle the components left after boiling (oil, salts etc.), thereby providing safer, better uptime, easier to dispose or sell the balance of the solids.
14. the batch cleaning when necessary is accomplished with a common low concentration food grade chemical cleaning acid
15. the system has additional cogeneration capabilities the high quality steam is suitable for (motive or electrical primary turbine power applications).
16. conventional equipment presently used in the oilfield (e.g. OTSG, HRSG and/or solar) can be combined with the system;
17. the concentrate output can be further processed and utilized commercially;
18. the system contributes to the local conservation of natural resources, water & hydrocarbons;
19. steam conveyance pipe network is simplified by the use of dry steam created by the system.

It will be apparent to those of skill in the art that the above embodiments are merely exemplary and that various modifications and improvements may be made thereto without departing from the scope of the disclosure.

For example, in addition to its usefulness in the oilfield, 100% quality saturated steam is normally considered useful for many industrial applications and it will be recognized that embodiments of the present disclosure may alternatively be used in steam generation for industrial uses or electrical power generation as well as production of pure disinfected water as a primary product.

The invention claimed is:

1. A water processing system comprising:

a reactor configured to receive a feed water input, the reactor configured to convert said feed water input into a de-mineralised steam output comprising from 99.8% to 100% dry steam for use in a downstream operation and a concentrate output, wherein the reactor is coupled to a first feed water source and a second feed water source, the first feed water source and the second feed water source configured to supply said feed water input, and wherein said first feed water source comprises water produced from a hydrocarbon reservoir and said second feed water source comprises at least one of:

seawater or brackish water;

water from at least one of: an Enhanced Oil Recovery System; a Package Boiler Blowdown System; a Co-generation Blowdown System; a Heat Recovery Steam Generator System; and a Once Through Steam Generator System; or condensate from a steam separator;

a chemical additive supply for adding chemical additives to the feed water input; and a heat generator arrangement operatively associated with the reactor, the heat generator arrangement comprising a heat source configured to supply thermal energy to the reactor, the heat source comprising heat generated from burning a fossil fuel;

heat generated from an electrical heat source;

heat generated from a renewable energy heat source; or heat generated from a concentrated solar power (CSP) thermal source, wherein the water processing system is configured to utilise thermal energy of the feed water input combined with the thermal energy supplied by the heat source in the conversion of the feed water input into the de-mineralised steam output and the concentrate output.

2. The processing system of claim 1, wherein the concentrate output comprises concentrated salts.

3. The processing system of claim 1, wherein the processing system comprises a closed-loop system.

4. The processing system of claim 1, comprising a separator arrangement.

5. A water processing method, the method comprising:

providing the water processing system according to claim 1;

adding the chemical additives to the feed water input prior to entering the reactor;

providing said feed water input and chemical additives to the reactor; and converting said feed water input into the de-mineralised steam output and said concentrate output using the thermal energy of the feed water input combined with the thermal energy supplied by the heat source to convert the feed water input into the de-mineralized steam output and the concentrate output; and thereby removing contaminants from the feed water input.

* * * * *